US011628489B2

(12) United States Patent
Gronen et al.

(10) Patent No.: US 11,628,489 B2
(45) Date of Patent: Apr. 18, 2023

(54) CORE SHOOTING APPARATUS AND METHOD FOR CONTROLLING CORE SHOOTING APPARATUS

(71) Applicant: MAGMA Giessereitechnologie GmbH, Aachen (DE)

(72) Inventors: Karl Gronen, Stolberg (DE); Ingo Wagner, Aachen (DE)

(73) Assignee: MAGMA GIESSEREITECHNOLOGIE GMBH, Aachen (DE)

( * ) Notice: Subject to any disclaimer, the term of this patent is extended or adjusted under 35 U.S.C. 154(b) by 0 days.

(21) Appl. No.: 17/516,937

(22) Filed: Nov. 2, 2021

(65) Prior Publication Data

US 2022/0055097 A1 Feb. 24, 2022

Related U.S. Application Data

(62) Division of application No. 16/159,935, filed on Oct. 15, 2018, now Pat. No. 11,192,173.

(30) Foreign Application Priority Data

Oct. 17, 2017 (EP) ..... 17196851

(51) Int. Cl.

| | |
|---|---|
| ***B22C 15/24*** | (2006.01) |
| ***B22C 19/04*** | (2006.01) |
| ***B22C 9/10*** | (2006.01) |

(52) U.S. Cl.

CPC ..... *B22C 15/245* (2013.01); *B22C 9/108* (2013.01); *B22C 15/24* (2013.01); *B22C 19/04* (2013.01)

(58) Field of Classification Search

CPC ..... B22C 9/10; B22C 9/108; B22C 15/24; B22C 15/245; B22C 19/04

USPC ..... 164/19, 20, 21, 22, 200, 201, 202

See application file for complete search history.

(56) References Cited

U.S. PATENT DOCUMENTS 11,192,173 B2 * 12/2021 Gronen et al. ..... B22C 15/245

* cited by examiner

*Primary Examiner* — Kevin P Kerns

(74) *Attorney, Agent, or Firm* — Taft Stettinius & Hollister LLP; Ryan O. White; Derek B. Lavender

(57) ABSTRACT

A core shooting machine (1) for producing cores by a process of shooting a core sand mixture (21) into at least one cavity (19) in a core box (18), the core shooting machine (1) having a source of compressed air (10) at an adjustable initial machine pressure ($P_0$), a shooting head (13) fluidically coupled to the source of compressed air (10) by at least one conduit (12) that includes an electronically controlled shot valve (11), the shooting head (13) being configured for containing an amount of the core sand mixture (21), resulting in a filling degree of the shooting head (13), and a computing device (50,60) associated with the core shooting machine (1) and being configured to perform a simulation of the process.

16 Claims, 7 Drawing Sheets

CORE SHOOTING APPARATUS AND METHOD FOR CONTROLLING CORE SHOOTING APPARATUS

This application claims the benefit of U.S. parent application Ser. No. 16/159,935 filed Oct. 15, 2018 and issued as U.S. Pat. No. 11,192,173; and further claims priority of European Patent Application EP2017196851, filed Oct. 17, 2017; both of which are incorporated by reference in their entirety.

TECHNICAL FIELD

The disclosure relates to a process that involves the flow of granular materials, where the expansion of compressed air is the driving force for filling a cavity with granular materials, e.g. for preparing a core to be used in a mold that is used for casting metal, such as a sand core. The disclosure also relates to a computer implemented method to control a machine for the production of shaped bodies consisting of granular materials, such as e.g. sand cores.

BACKGROUND

Sand cores are widely used in a variety of casting processes for the production of metal cast parts using diverse metal alloy types for a wide range of applications. Sand cores represent inner hollow structures of castings. Basic requirements of sand cores relate to mechanical strength, dimensional accuracy and chemical stability. Sand cores consist of a basic sand (granular material) and a binder system. Up-front to the main core production process, sand, binder components and optionally additives are mixed together using particular equipment. For the main production process core shooting machines are used.

The production of sand cores by using so called core shooting machines is widely used in industrial practice. Core shooting is a highly complex process that is characterized by a coupled flow of air and sand. In practice the process is controlled applying trial and error until the process works for a particular core box linked to the machine. The process in practice has a number of uncertainties leading to a variable sand core quality. In state of the art machines there is actually no dynamic machine control available that may be able to readjust the process pressure and other process conditions in accordance to variable process conditions.

In the art there is a basic lack in the measurement of important state variables which determine the transient process sequence. Actually, there are no measurement capabilities available in order to determine separately for air and sand the transient mass flow, the velocities at local positions within the relevant machine positions and also within the core box.

The availability of the missing information would enable a drastic improvement of reliable core production in industrial practice. The determination of the transient process conditions in real time (time for calculation is shorter than the cycle time) would enable the adjustment of process conditions between one production cycle and the next. That would enable a dynamic and real time process control.

SUMMARY

It is an object to provide a core shooting machine that overcomes or at least reduces the problems mentioned above.

The foregoing and other objects are achieved by the features of the independent claims. Further implementation forms are apparent from the dependent claims, the description and the figures.

According to a first aspect, there is provided a core shooting machine for producing cores by a process of shooting a core sand mixture into a at least one cavity in a core box that is associated with the core shooting machine, the core shooting machine comprising:

a source of compressed air at an adjustable initial machine pressure $P_0$, the adjustable initial machine pressure $P_0$, being an adjustable process condition of the process, and a shooting head fluidically coupled to the source of compressed air by at least one conduit that includes an electronically controlled shot valve, the shooting head being configured for containing an amount of the core sand mixture, resulting in a filling degree of the shoot head, the filling degree being an adjustable process condition of the process, and a computing device associated with the core shooting machine, the computing device being configured to perform a simulation of the process, the simulation using a model of the process, the computing device being configured to be informed of several process conditions, including the adjustable process conditions.

By providing of core shooting machine with a computing device configured to simulate the core shooting process it becomes possible to provide a recommendation for any of the adjustable settings/process conditions of the core shooting machine. This allows adjusting of the core shooting machine to changing conditions before the quality of the produced cores deteriorates to an unacceptable level. Consequently, the quality of the produced cores can be maintained at a stable high level and time is safe that is otherwise used to empiric (trial and error) adjustment of the adjustable setting/process conditions.

In a possible implementation form of the first aspect the computing device is configured to perform a simulation of the process to determine an improved or optimal setting for one or more adjustable process conditions based on the result of a performed simulation.

In a possible implementation form of the first aspect the computing device is configured to perform a simulation for each process cycle or for each given number of process cycles.

In a possible implementation form of the first aspect the computing device is configured to perform a simulation in less time than a process cycle and preferably during each process cycle.

In a possible implementation form of the first aspect the model is a mathematical-physical model of the process, preferably, a simplified mathematical-physical model of the process.

In a possible implementation form of the first aspect the model is a simplified 1-D representation of set process, preferably considering the main local flow direction.

In a possible implementation form of the first aspect the computing device is informed of, and the model takes into account one or more of the following process conditions:

- length of opening time for the electronically controlled shot valve,
- characteristics of electronically controlled shot valve,
- opening degree profile of shot valve,
- shape and dimension of the conduit upstream of shot valve, shape and dimension of the conduit downstream of shot valve,
shape and dimension or volume of the shoot head,
shape and dimension or volume of the shot cylinder,
shape, dimension and number of openings,
characteristics of the source of pressurized air, e.g. volume of a pressurized air container associated with the source of pressurized air,
shape, dimension and number of shoot nozzles,
shape, dimension and number of cavities,
number, characteristics and positioning of vents
properties of sand core mixture, e.g. granularity, rheological properties, binder properties.

In a possible implementation form of the first aspect the computing device is coupled to the core shooting machine.

In a possible implementation form of the first aspect the computing device is part of the core shooting machine.

In a possible implementation form of the first aspect the core shooting machine comprises a sensor for detecting the filling degree, the sensor being coupled to the computing device.

In a possible implementation form of the first aspect the computing device is configured to provide a recommendation based on the result of a performed simulation for the initial machine pressure $P_0$ and/or for the filling degree H.

According to a second aspect, there is provided a method for controlling a core shooting machine for producing cores by a process of shooting a core sand mixture into at least one cavity in a core box that is associated with the core shooting machine, the core shooting machine comprising:
a source of compressed air at an adjustable initial machine pressure $P_0$,
the adjustable initial machine pressure $P_0$, being an adjustable process condition of the process, and
a shooting head fluidically coupled to the source of compressed air by at least one conduit that includes an electronically controlled shot valve,
the shooting head being configured for containing an amount of the core sand mixture, resulting in a filling degree of the shoot head
the filling degree being an adjustable process condition of the process,
the method comprising performing a simulation of the process on a computing device, using a model of the process, on the basis of several process conditions, including the adjustable process conditions, and determining an improved or optimal value for one or more adjustable process conditions based on the result of a performed simulation, and adjusting one or more of the adjustable process conditions in accordance with the determined improved or optimal value.

In a possible implementation of the second aspect the method comprises solving a system of coupled equations to determine the transient fluid flow of the sand core mixture and air.

In a possible implementation of the second aspect the model is a mathematical-physical model of the process, preferably, a simplified mathematical-physical model of the process.

In a possible implementation of the second aspect the model is a simplified 1-D representation of the process, preferably considering the main local flow direction.

In a possible implementation of the second aspect the method comprises providing a recommendation based on the result of a performed simulation for the initial machine pressure $P_0$ and/or for the filling degree H.

According to a third aspect, there is provided a non-transitory computer readable medium comprising computer program code for implementing a method according to any one of the possible implementations of the second aspect, the non-transitory computer readable medium comprising:
software code of a computer model of a process of shooting a core with a core shooting machine,
software code for performing a numerical simulation of the process using the model,
software code for outputting a recommended or optimal value for an adjustable process condition of the process.

According to a fourth aspect, there is provided a method for simulating, on a computing device, a process performed by a core shooting machine for producing cores by shooting a core sand mixture into at least one cavity in a core box that is associated with the core shooting machine, the method comprising
informing the computing device of several process conditions, including one or more adjustable process conditions, of the process,
performing a simulation of the process on the basis of the process conditions, using a model of the process, and determining an improved or optimal value for the one or more adjustable process conditions based on the result of the simulation,
wherein the model is a simplified 1-D representation of the process, considering the main local flow direction.

In a possible implementation of the fourth aspect the computing device is configured to perform a simulation for each process cycle or for each given number of process cycles of the process.

In a possible implementation of the fourth aspect the computing device is configured to perform a simulation in less time than a process cycle and preferably during each process cycle.

In a possible implementation of the fourth aspect the core shooting machine comprises a source of compressed air at an adjustable initial machine pressure, and
a shooting head fluidically coupled to the source of compressed air by at least one conduit that includes an electronically controlled shot valve, the shooting head being configured for containing an amount of the core sand mixture, resulting in a filling degree of the shooting head;
and the one or more adjustable process conditions comprise the adjustable initial machine pressure and the filling degree.

In a possible implementation of the fourth aspect the method comprises informing the computing device of one or more of the following process conditions:
length of opening time for the electronically controlled shot valve,
characteristics of electronically controlled shot valve,
opening degree profile of electronically controlled shot valve,
shape and dimension of the conduit upstream of shot valve,
shape and dimension of the conduit downstream of shot valve,
shape and dimension or volume of the shooting head,
shape and dimension or volume of the shot cylinder,
shape, dimension and number of openings,
characteristics of the source of pressurized air,
shape, dimension and number of shoot nozzles,
shape, dimension and number of cavities,
number, characteristics and positioning of vents,
properties of sand core mixture, e.g. granularity, rheological properties, binder properties.

In a possible implementation of the fourth aspect the method comprises solving a system of coupled equations to determine the transient fluid flow of the sand core mixture and air.

In a possible implementation of the fourth aspect the model takes into account the interdependencies between the core shooting machine and the coupled cavity in accordance with the transient process conditions.

In a possible implementation of the fourth aspect the method comprises calculating the mass balance of sand between the shooting head, shoot nozzles and core box cavity; and calculating the mass balance of air including the initial air mass within the different parts of the core shooting machine and the core box and the loss of air during the process.

In a possible implementation of the fourth aspect the model is further simplified by considering air to be incompressible.

In a possible implementation of the fourth aspect the model is further simplified by considering air to be compressible and considering sand to be incompressible.

In a possible implementation of the fourth aspect the computing device is in data connection with the core shooting machine or is part of the core shooting machine.

These and other aspects will be apparent from and the embodiment(s) described below.

BRIEF DESCRIPTION OF THE DRAWINGS

In the following detailed portion of the present disclosure, the aspects, embodiments and implementations will be explained in more detail with reference to the example embodiments shown in the drawings, in which.

DETAILED DESCRIPTION

In the following detailed description, a core shooting machine and a method to control the core shooting machine are described in detail with reference to exemplary embodiments.

Figure 1:
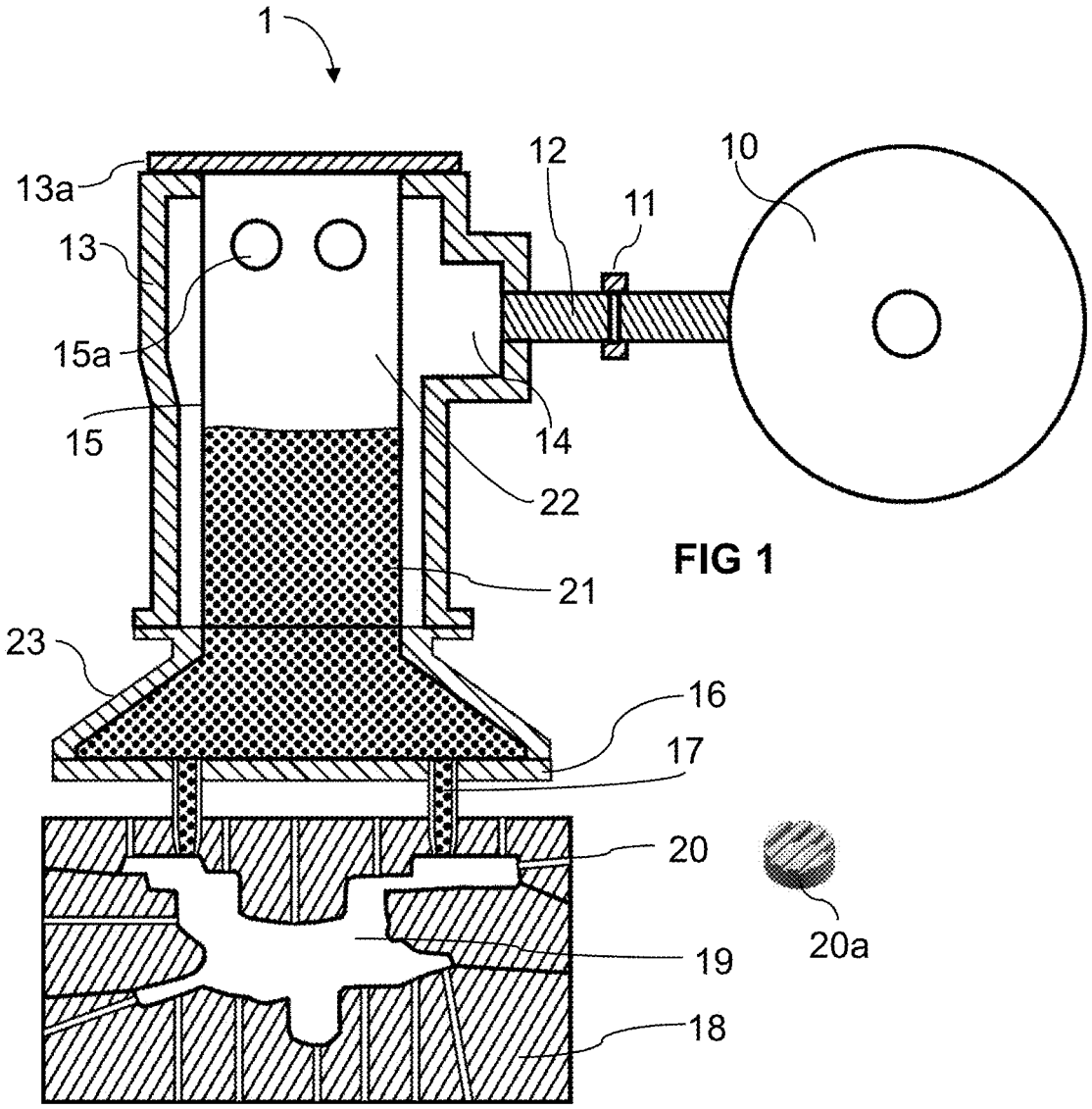
FIG. 1 illustrates a basic set-up of a typical core shooting machine, identifying the functional parts, used for the process and a core box including a cavity representing an example of shape of the sand core to be produced.

FIG. 1 illustrates an example embodiment of a core shooting apparatus or machine 1, showing the main functional parts. In practice details may vary but the process principles typically are the same for various types of core shooting machines 1.

The core shooting apparatus is provided with a pressure tank 10. The pressure tank 10 is used to store a certain amount of compressed air (other gases can be used) ahead of a production cycle. The main body of the core shooting machine 1 is the shoot head 13, typically closed on top, e.g. using a cover 13*a*. The shoot head 13 is also referred to as hopper, blow head, or magazine. The pressure tank 10 and the shoot head 13 are connected by one or more tubes 12. One or more electronically controlled shot valves 11 control the passage of air through the tubes 12. The electronically controlled valve or shot valves 11 are operated under control of a computing device 60 (FIG. 5) that is part of or associated with or coupled to the core shooting machine 1. In the shown embodiment a shot cylinder 15 is inserted in the shoot head 13. In the shown embodiment there is an outer space 14 inside the shoot head 13 but outside the shot cylinder 15. Openings 15*a*, which are permeable for air/gas, form a passage for air to flow into the shot cylinder 15. In an embodiment (not shown), the core shooting machine 1 is constructed without a shot cylinder 15. In this embodiment, there is a simplified cavity 14 inside the shoot head 13. At the bottom the shoot head 13 is closed by a shot plate 16. In the shown embodiment the lower portion 23 of the shoot head 13 widens towards the shot plate 16 to provide a larger area for interaction with a core box 18. The shot plate 16 typically contains holes, where air and sand of a core sand mixture can flow out. The shot plate 16 is in an embodiment directly connected to the core box 18. In the present embodiment shoot nozzles 17 are inserted to the holes of the shot plate 16. The shoot nozzles 17 are also referred to as blow tubes.

The shoot nozzles 17 connect the core shooting machine 1 to the core box 18. Typically, a gap is formed between shot plate and core box 18, as shown in the embodiment of FIG. 1. The core box 18 contains one or more cavities 19, representing the shape(s) of the sand core(s) to be produced. The core box 18 typically consists of two or more parts, depending on the complexity of the sand core(s).

The core box 18 typically contains several channels 20 which are used for venting air out of the core box 18. In order to minimize sand flow into these channels 20, bodies having reduced open area, so-called vents 20*a* are positioned at the end of the channels 20 at the interface to the cavity 19. There are several types of vents available having different amounts of open area. Vent 20*a* shows a typical design of a metal body with slotted passages. The slot width typically is in a range of e.g. 0.2 mm to 0.6 mm, depending on the grain size distribution of the basic sand to be used.

The production of sand cores using the core shooting machine 1 is as follows:

A certain amount of prepared core sand mixture 21 is filled into the shoot head 13. The filling height H (FIG. 2) of the core sand mixture 21 depends, among possible other aspects, on the size of the core shooting machine 1 and on and shape, dimensions and number of the core cavities 19 to be filled. The pressure tank 10 is preferably simultaneously filled with compressed air until a predefined shot pressure $P_0$ is achieved. Typically, the shot pressure can be selected in a range between 2 extremities, such as e.g. 2 and 8 bar. The shot pressure to be applied is in the prior art determined by trial and error in accordance to quality criteria. Typically, higher shot pressure values lead to better core quality but also reduce the life time of the core box 18 due to increased abrasion (attrition) effects.

The core shooting process is activated by opening one or more electronically controlled shot valves 11 under command from the computing device 60. Special valve types are used as shot valves 11, which open very quick, e.g. in 0.1 to 0.3 seconds. Then, the compressed air expands out of the pressure tank 10 through the tubes 12 into the shoot head 13. In the area 14 and within the shot cylinder 15 in the volume above the sand 22, a high pressure level Pi ($<P_0$) is achieved rapidly. In direction of the highest pressure gradient the air also starts flowing through the core sand mixture 21 within the shot cylinder 15 downwards towards the shoot nozzles 17. The granular character of the core sand mixture together with locally varying compaction degree leads to a significant pressure loss. There is a significant pressure gradient, particularly in vertical direction. Another correlated effect is a significant time shift for the development of pressure within the area filled with core sand mixture 21. The flowing air interacts with the granular particles of the core sand mixture. Thus, the flowing air is the driving force for the sand flow. The sand follows the air flow through the shoot nozzles 17 into the core box cavities 19. While flowing into the core box 18 the sand is accelerated and has a certain kinetic energy. Within the cavity 19 inflowing sand is compacting and slowing down. While the air is exhausted out of the core box 18 through the vent bodies 20*a*, the core sand mixture remains at a preferably high compaction degree within the core box cavity 19.

If the shooting process proceeds as planned, the cavity 19 is completely filled with sand and the resulting sand core has a high and homogeneous compaction degree at the end of the shooting process. After a certain time, i.e. when the cavity 19 is completely filled, the shot valve 11 is closed. The shoot head 13 is vented by opening shoot head valves (not shown) until atmospheric pressure is reached inside the shoot head 13. Next, the shoot head 13 is moved upwards, to allow the core box 18 to be removed for curing and ejection of the sand core, thereafter to be placed back in the core shooting machine 1.

The core sand mixture 21 comprises a binder, together typically referred to as a binder system. Depending on the chemistry of the binder system different technologies are then applied in order to cure the core. While curing, binder between the sand grains and the surface layer on the sand grains develops a solid 3D-network thus resulting in a certain mechanical strength of the resulting sand core. After the curing procedure, the core box 18 is opened, moved out of the core shooting machine 1 and the cured sand core is ejected. The exact procedure may vary dependent on the machine type and the core box design. After ejection of the sand core the core box 18 is moved back into the core shooting machine 1 and closed. Then the production steps are repeated as described above.

Sand core production using a core shooting machine 1 is highly productive. Depending on e.g. the core size, the number of cores in the cavity 19 and the cycle time, a significant number of cores can be produced in one day.

The core production process involves a lot of uncertainties. Production conditions are typically not as reproducible as desired and consequently core quality and scrap rate may vary in unexpected manner. From the machine side the process is mainly controlled by the initial pressure $P_0$ in the pressure tank 10 at the start of to the production cycle. Another means for additional process control may be to vary the operation of shot valve 11, or to add further valves and connecting tubes that can be controlled independent of each other. This type of process control is described in WO2016095179A1 and DE112014005849T5.

The process conditions may vary to some extent between one production cycle and the next. Refilling the shoot head 13 with sand typically results in variable initial sand height H. The shoot head 13 may be shot empty over a couple of cycles and then being refilled. The transient process conditions within the core shooting machine 1 also strongly depend on the specific core box 18 that is coupled to the core shooting machine 1. The total cavity volume 19, number, positions and diameter of the shoot nozzles 17 as well as number positions and open area of the vents 20*a* affect the transient process conditions. In addition, the open area of the vents 20*a* may change in cycle operation due to clogging of the open area with sand grains and cured binder.

In prior the art machines there is actually no dynamic machine control available that allows readjusting the process pressure in accordance to variable process conditions as described. When e.g. the sand height H in the shoot head 13 varies between single production cycles readjustment of the process conditions is necessary in order to maintain constant process state variables and to realize reliable core quality. The only process factor that is determined (measured) in the prior art is the initial air pressure $P_0$ in the pressure tank 10.

In the known art there is a basic lack in the measurement of other important process variables which determine the transient process sequence. Actually, there are no measurement capabilities in the prior art to determine separately for air and sand the transient mass flow, the velocities at local positions within the relevant positions, neither within the core shooting machine 1 and nor within the core box 18.

It is herewith proposed to obtain the missing information by the miracle simulation of the conditions inside the core shooting machine 1 and in an embodiment also inside the core box 18 using a model. The numerical simulation imitates the operation of the real-world core shooting process and core shooting machine 1 over time. The numerical simulation requires a mathematical-physical model or logical representation of the core shooting process or core shooting machine. This model represents the key characteristics, behaviors and functions of the selected core shooting machine and core shooting process. The model represents the system/process itself, whereas the simulation represents the operation of the system/process over time. Numerical simulation uses models, a mathematical, or otherwise logical representation of a system, entity, phenomenon, or process—as a basis for simulations.

The availability of the missing information through numerical simulation enables a drastic improvement of reliable core production in industrial practice. It is further proposed that the determination of the transient process conditions is in real time (i.e. the time for calculation is shorter than the cycle time) enables the adjustment of process conditions between one production cycle and the next. This enables real time process control.

Although there is a basic lack in measurement of the highly dynamic and coupled fluid flow of air and sand, the transient process can be determined through calculation. A mathematical-physical model can be used to simulate the process on a computer. A mathematical-physical model is used for a 3D process simulation. Such software, like e.g. MAGMASOFT® provides comprehensive capabilities for process simulation of core production, including the optimization of core box design.

In practice a goal is to design robust core boxes 18 before they are manufactured and where the unexpected variation of process conditions does not significantly affect the core quality. In the 3D process simulation, all the relevant parts of the core shooting machine 1 and core box 18 are represented as 3D volumes. The process simulation calculates the complete transient flow of air and sand. Thus, complete process transparency is obtained.

However, a core shooting production cycle is typically in the order of one minute, and a 3D simulation with the above-mentioned software lasts significantly longer and is therefore not an appropriate tool for real time process control.

It is proposed here to provide a method for rapid calculation of the required information in real time. In the core shooting process air and sand flow are driven by the pressure gradient of the air. The complex 3D representation of the process can be reduced to a simplified 1D representation considering the main local flow direction.

Figure 2:
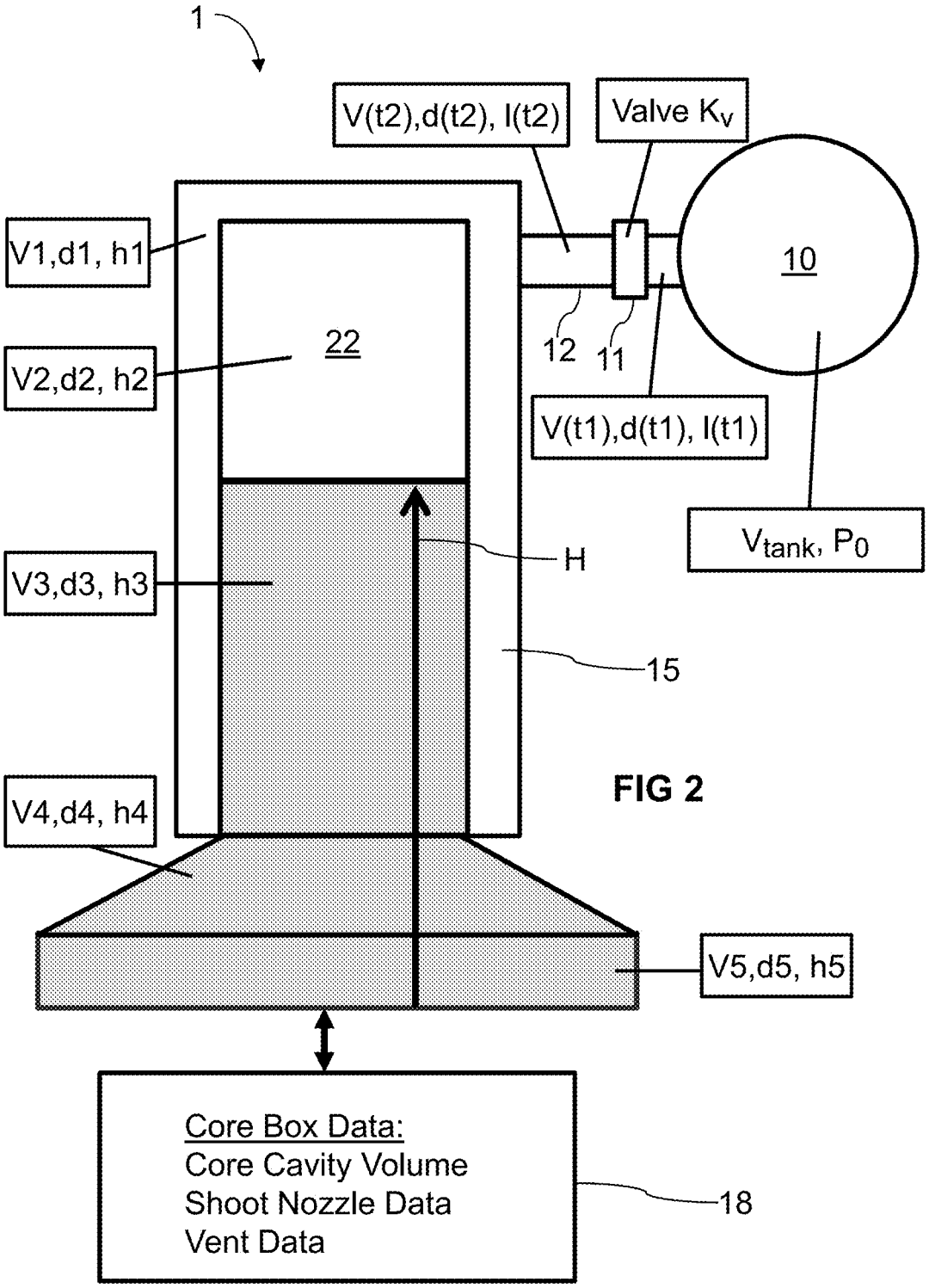
FIG. 2 illustrates a schematic set-up of the core shooting machine of FIG. 1, showing representative diameters, volumes of relevant machine parts and valves associated with the core shooting machine.

The relevant parts of the core shooting machine 1 as well as the coupled core box 18 can be represented in a simplified way by using local geometrical volumes (V), diameters (d) and distances (height h and length 1) as well as production relevant process conditions such as the initial air pressure $P_0$ in pressure tank 10 or the height of the core sand mixture 21 in the shooting unit 15. FIG. 2 illustrates the input for the calculation.

All transient state variables are calculated at any position of the entire process. Typically, it is of interest to examine areas having different transient flow conditions. Sketching the process along the assumed one dimensional flow, the first area is in this embodiment the pressure tank 10 and the tube 12 before (upstream of) the shot valve 11. The next area of interest is the shot valve 11. Before and after the shot valve 11, the air pressure and air flow conditions differ significantly. The shoot head 13 has two different areas. The outer area 14 and the upper part of shot cylinder 15 containing only air, have almost the same transient behavior because single phase gas flow is very quick when compared to coupled two phase flow of air and sand. The lower inner region of the shoot head 13 which is filled with core sand mixture 21 is of particular interest. During the process the sand level H in the shoot head 13 lowers in accordance with the filling of the core box 18. In conformity to the lowering of the sand level, the air volume 22 above the sand increases. The shoot nozzles 17 are of particular interest. The variously shaped geometries have much smaller diameters when compared to the shoot head 13. Primarily through the shoot nozzles 17, the sand is accelerated. The coupled flow of air and sand through the shoot nozzles 17 requires the consideration of adjusted pressure loss conditions. At the beginning of core box filling the air easily can escape out of the vent bodies 20*a*. At that time there is no significant pressure development in the core box cavity 19 which would reduce the vertical pressure gradient and thus the fluid flow out of the shoot head. With increasing filling degree of the core box 18, filling from the bottom to the top, there is a progressive reduction of open area for the venting at the vent bodies 20*a*. Compacting sand in front of the vents 20 reduces the venting effectivity. Additionally, air has to flow through compacted sand which adds further flow resistance with dynamically increasing pressure loss. The overall mass balance of air and sand needs to be monitored. While sand is moving inside the system, the mass balance is calculated between shoot head 13, shoot nozzles 17 and core box cavity 19. The mass balance of air includes the initial air mass within the different parts of the machine and the core box 18 and the loss of air during the process, where air is escaping out of the vents 20 and thus leaving the system.

The determination of the transient process requires several of basic equations as known from standard textbooks for fluid dynamics as is state of the art to any person skilled in the field of fluid dynamics. The equations are formulated for one-dimensional calculation:

1.) Constitutive equation for the pressure, dependent on the compressibility of air:

$$P/P_{ref}=(\rho/P_{ref})^{\kappa}$$

The isentropic exponent for air compression usually can be approximated to $\kappa:=1.4$ 2.) Continuity equations where air is considered to be compressible and sand to be incompressible:

$$\partial(\varepsilon_i\rho_i)/\partial t+\mathrm{div}(\varepsilon_i\rho_i U_i)=0$$

where i=a in case of air and i=s in case of sand:

a) for compressible air $\rho_a$, the one-dimensional equation is:

$$\partial(\varepsilon_a\rho_a)/\partial t+\partial(\varepsilon_a\rho_a W_a)/\partial z=0$$

b) for incompressible sand, $\rho_s$=constant, the resulting one-dimensional equation is:

$$\partial\varepsilon_s/\partial t+\partial(\varepsilon_s W_s)/\partial z=0$$

3.) Momentum equation:

$$\partial(\varepsilon_a\rho_a W_a)/\partial t+\partial(\varepsilon_a\rho_a W_a^2)/\partial z=-\partial P/\partial z+\Sigma\ \text{source-terms}$$

The source-terms include:

a) Frictional losses (e.g. wall friction and turbulence), b) Losses in the machine specific pressure valve, using characteristic $K_V$-values c) Losses in the machine specific tubes, applying a specific friction coefficient λ, d) Interface forces between air and sand, e.g. within the shot cylinder considering $W_s \ll W_a$:

$$F_{a,s}:=-(\beta_1+\beta_2 * M_P(z,t)) * W_a(z,t)$$

e) Losses due to the acceleration of sand within the shoot nozzles f) Losses during filling of the core box cavity in accordance to d)

g) Pressure losses within the vents using characteristic ζ-values h) Gravity driven acceleration due to the weight of sand in z-direction.

Description of Used Variables:

$F_{a,s}$ Interface force between air and sand [N]

$K_V$ $K_V$-value, characteristic pressure loss of pressure valve [-]

$M_P(z)$ Mass flow of compressible air [kg/s]

P Total air pressure [Pa]

$P_{ref}$ Reference pressure of air (standard conditions) [Pa]

$Q_P$ Volume flow of compressible air [$m^3$/s]

t Time [s]

$t_0$ Time for opening valve at pressure tank tube [s]

$U_i(x,y,z,t)$ Velocity vector of phase i $W_a$ Phase velocity of air [m/s]

$W_s$ Phase velocity of sand [m/s]

$\beta_1$ Linear term of interface force $F_{a,s}$ $\beta_2$ Quadratic term of interface force $F_{a,s}$ $\varepsilon_a$ Volume fraction of air [-]

$\varepsilon_s$ Volume fraction of sand [-]

ΔP Pressure difference [Pa]

ζ Zeta-value, constant pressure loss coefficient (e.g. for vents) [-]

κ Constant isentropic exponent of compressible air $\kappa:=C_P/C_V=1.4$ [-]

λ Friction coefficient in tubes [-]

ρ Density [kg/$m^3$]

$\rho_a$ Compressible density of air [kg/$m^3$]

$\rho_{ref}$ Reference density of air [kg/m$^3$] (standard conditions)
$\rho_s$ constant density of sand particles [kg/m$^3$]

It is clear to a skilled person in the field of fluid dynamics how to combine the basic equations together with the additional terms for any position in the system. It is also clear that considering air to be incompressible would be a simplification of the present application. Furthermore, it is clear to any skilled person in the field of numerical mathematics how to solve the resulting system of coupled equations.

Figure 3:
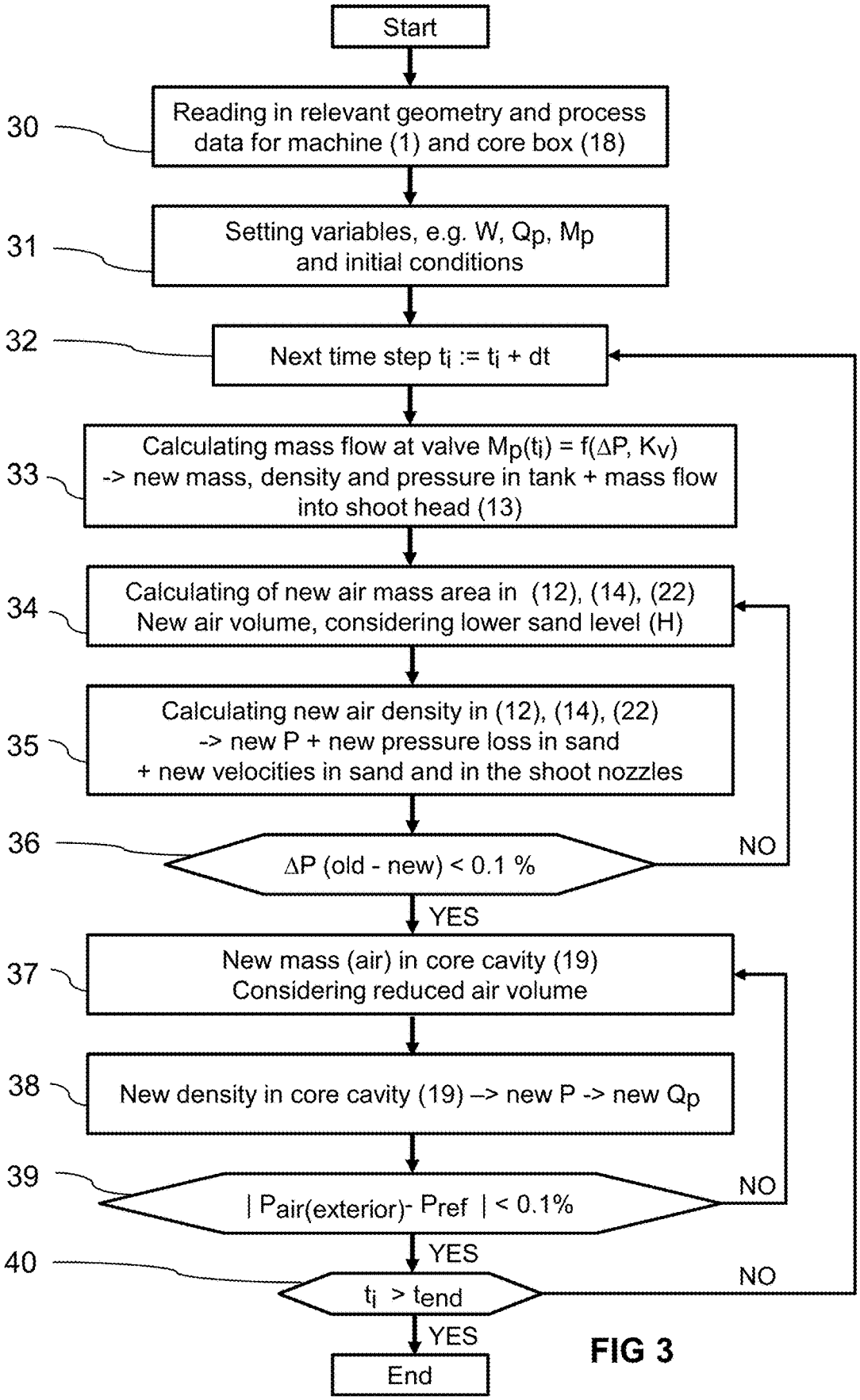
FIG. 3 is a flow diagram illustrating a method of controlling the core shooting machine of FIG. 1.

The flow diagram in FIG. 3 represents an embodiment of the process control module 50 (also referred to as computing device or electronic control unit) indicating the iterative solution of the transient flow based on the one-dimensional model. The description in the flow diagram focuses on the calculations for compressible air, which dominates the coupled flow of compressible air and incompressible sand. Considered in the calculation are air and sand for all areas. The description of the process shows that in all areas (volumes), air is present and also shows that sand is present in areas of the shoot head 13, in the shoot nozzles 17 and within the core box cavity 19.

At the beginning of the calculation in step 30 relevant geometry and process data as indicated in FIG. 1 and FIG. 2, are read in. For the core shooting machine 1 shown in the Figs. these are e.g.:

- The initial pressure $P_0$ and the volume of the pressure tank 10,
- diameter and length of tube 12 from pressure tank 10 to the shot valve 11,
- the characteristics of the shot valve 11 such as a $K_V$-value and valve opening time,
- length and diameter of tube 12 from the shot valve 11 to the shoot head,
- volume, (effective) diameter and height of the outer area 14,
- diameter and height of the shot cylinder 15 which initially filled with air,
- diameter and height and volumes (if not calculated from diameter end height) of the sand filled part of the shoot head 13 (correspondent parts with indices 3 to 5 in FIG. 2).

For the core box 18, useful data are:

- number, diameter, length and specific pressure loss of all shoot nozzles 17, which may be of different types,
- volume and geometry specific information of the cavity 19,
- number, position (basically distinguished in vertical direction) and pressure loss properties of all vent bodies 20*a*, which may be of different types.

It is noted that not all of the geometry and process data listed above are required for a meaningful simulation and it is noted that additional geometry and process data can also be used.

The shoot nozzles 17 connect the core shooting machine 1 to the core box. They are part of both systems if one of them, core shooting machine 1 or core box 18 is analyzed separately.

Machine specific data can be provided by a database. The input data also may be typed in manually via keyboard using an appropriate interface.

In step 31 the initial values for calculation are set. Then starts the main iterative calculation with the first time step where the shot valve 11 starts opening in step 32.

In step 33 the mass flow through the shot valve 11 is calculated. At the end of the time step there are new values for mass, density and pressure in the pressure tank 10 and also for the shoot head 13.

In step 34 the resulting changes for the air mass in the air volume area of the shoot head 13 are calculated (volumes 14 and 22) and also volume changes of this area (considering the lowering of the core sand mixture level H of area 21).

In step 35 the air density is calculated for the volumes 14 and 22. The result includes a new air pressure, new pressure loss in all sand areas, new velocities in the core sand mixture 21 and in the shoot nozzles 17.

In step 36 it is checked if the new pressure loss leads to a new pressure in the core box cavity 19, where the value is within a threshold value when compared to the last value. If not, the steps 34 and 35 are repeated.

If the required accuracy is reached, the mass flow into the core cavity 19 is calculated in step 37. Two different masses need to be considered. The new air mass in the cavity 19 (which may be reduced by an amount of vented air) and the new sand mass, where it can be assumed that the core sand mixture compacts within the cavity 19 from the bottom to the top.

In step 38 the new air density (above the area filled with core sand mixture) is calculated. The new density leads to a new air pressure where the air flow out of the vents 20 and the variation of the local pressure losses are considered.

In step 39 the new pressure outside the vents 20 is compared to the reference pressure. If the difference is not smaller than the threshold value, the steps 37 and 38 are repeated.

Step 40 checks the actual time step and the calculation jumps back to step 32 until the total process operation time to be considered for calculation is reached or e.g. until the core box cavity 19 is completely filled with compacted sand (core sand mixture). The total calculation is executed in very short time and does not necessarily need a high-performance computing device.

At the end of the calculation detailed results are available for all the different areas in the system. The transient results include the mass flow and the velocity, separately for air and for sand (core sand mixture). Air and sand fraction are available for all areas where sand and air are both present. The transient mass balance is available for all areas. These results cannot be measured in reality and thus provide important information for designing and operating core shooting machines 1 as well as for the optimization of core boxes 18.

Figure 4A:
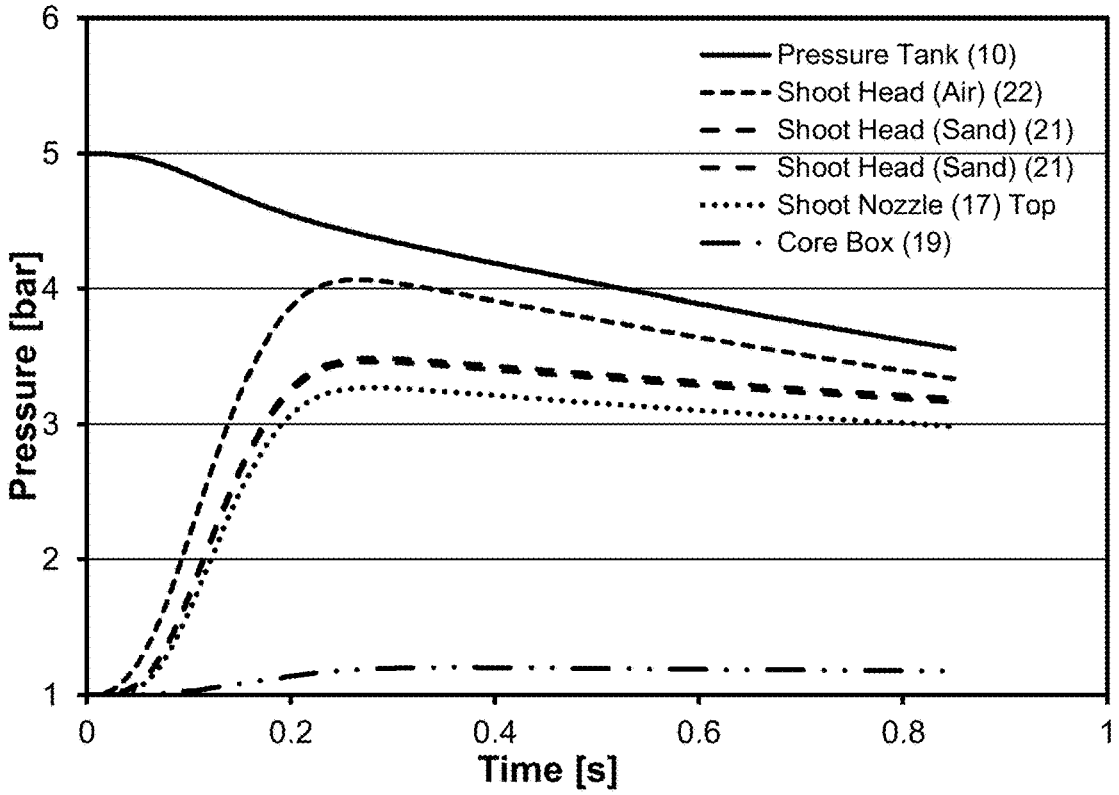
FIG. 4*a* is an example of a graph representing a calculation output, transient pressure curves at different positions with a low number of shoot nozzles.
Figure 4B:
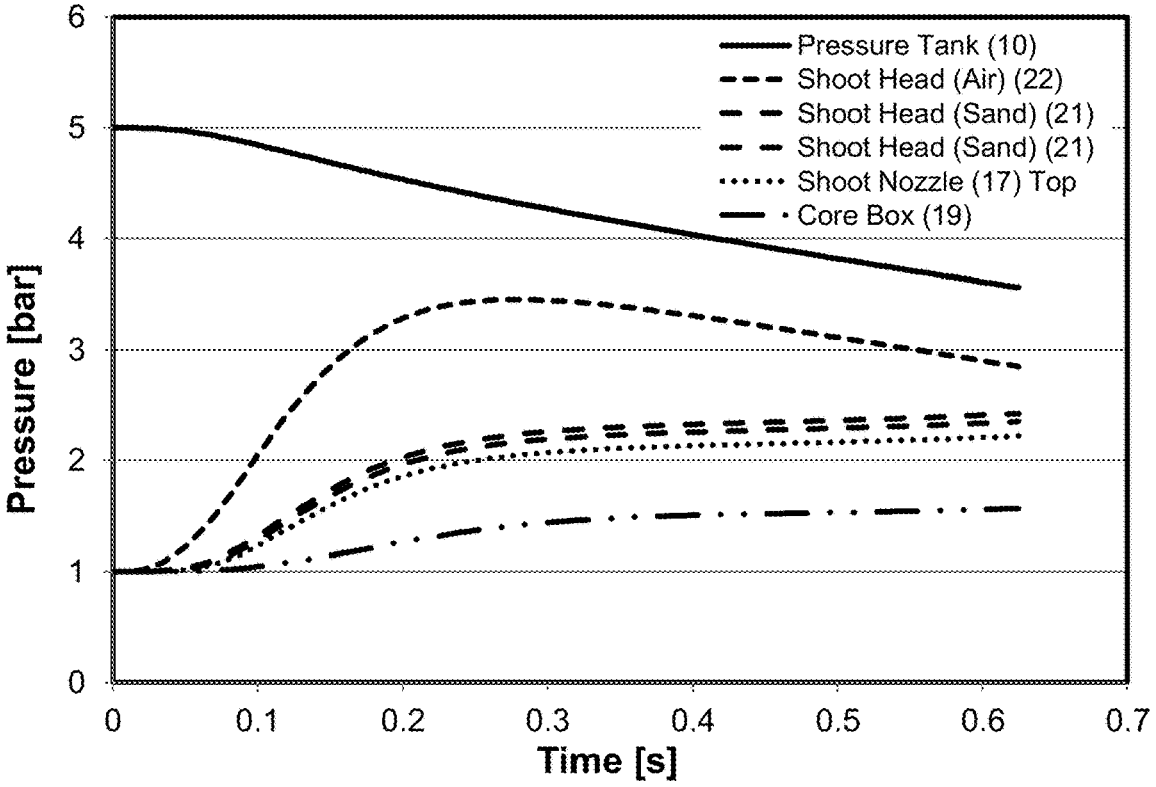
FIG. 4*b* is an example of a graph representing of calculation output, transient pressure curves at different positions with on increased number of shoot nozzles.
Figure 4C:
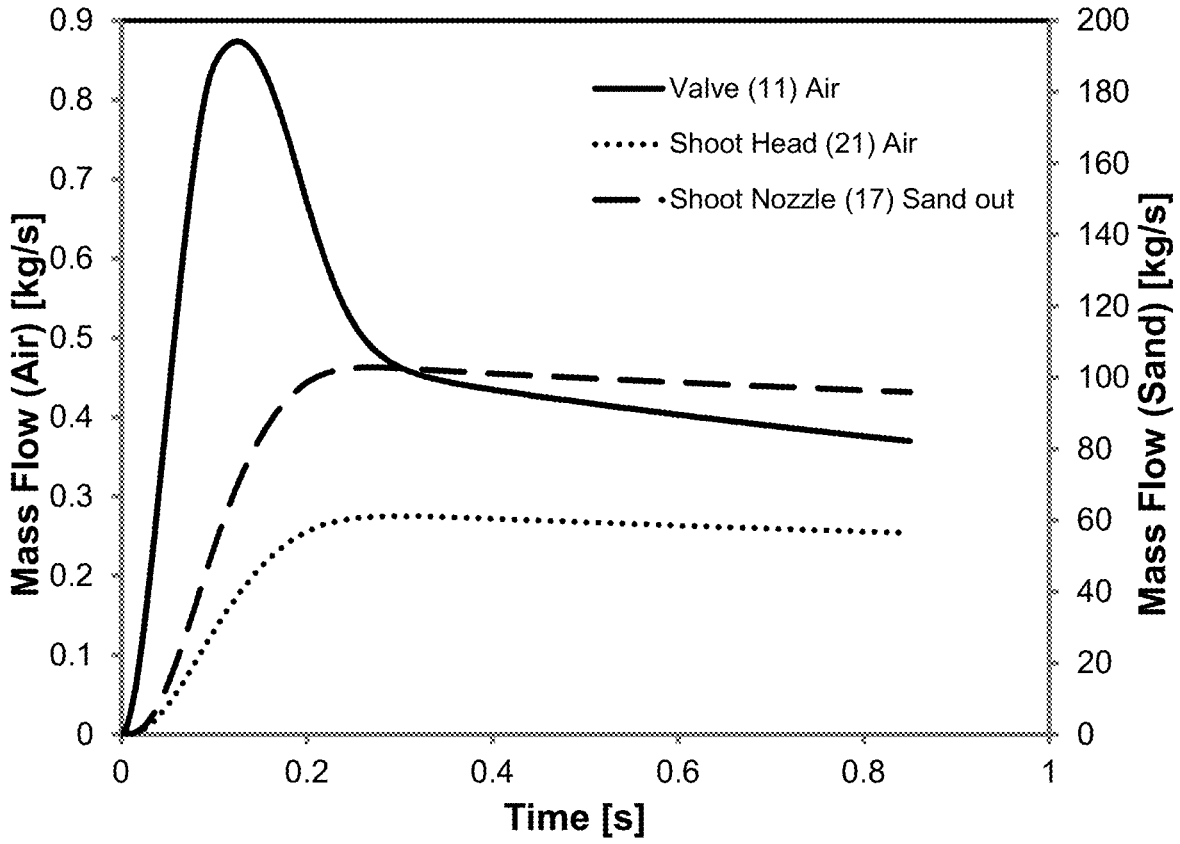
FIG. 4*c* as an example of a graph representing a calculation output, transient air mass flow and sand mass flow.

Transient results for air pressure are available for all areas. FIG. 4*a* and FIG. 4*b* show examples for typical curves as received for different core boxes 18. These figures demonstrate how a variation of shoot nozzles 17 influences the transient pressure within the specific areas of the core shooting machine 1. FIG. 4*c* shows examples for transient mass flow of air and of sand.

The pressure data can directly be used to calibrate and to adjust the machine operation as well as for designing and optimizing core shooting machines 1. The concept can be used independent of the core shooting machine 1 by any suitable computing device. The data calculated using the process control module 50 (computing device or electronic control unit) can also be used as a dynamic boundary condition in the 3D process simulation.

Figure 5A:
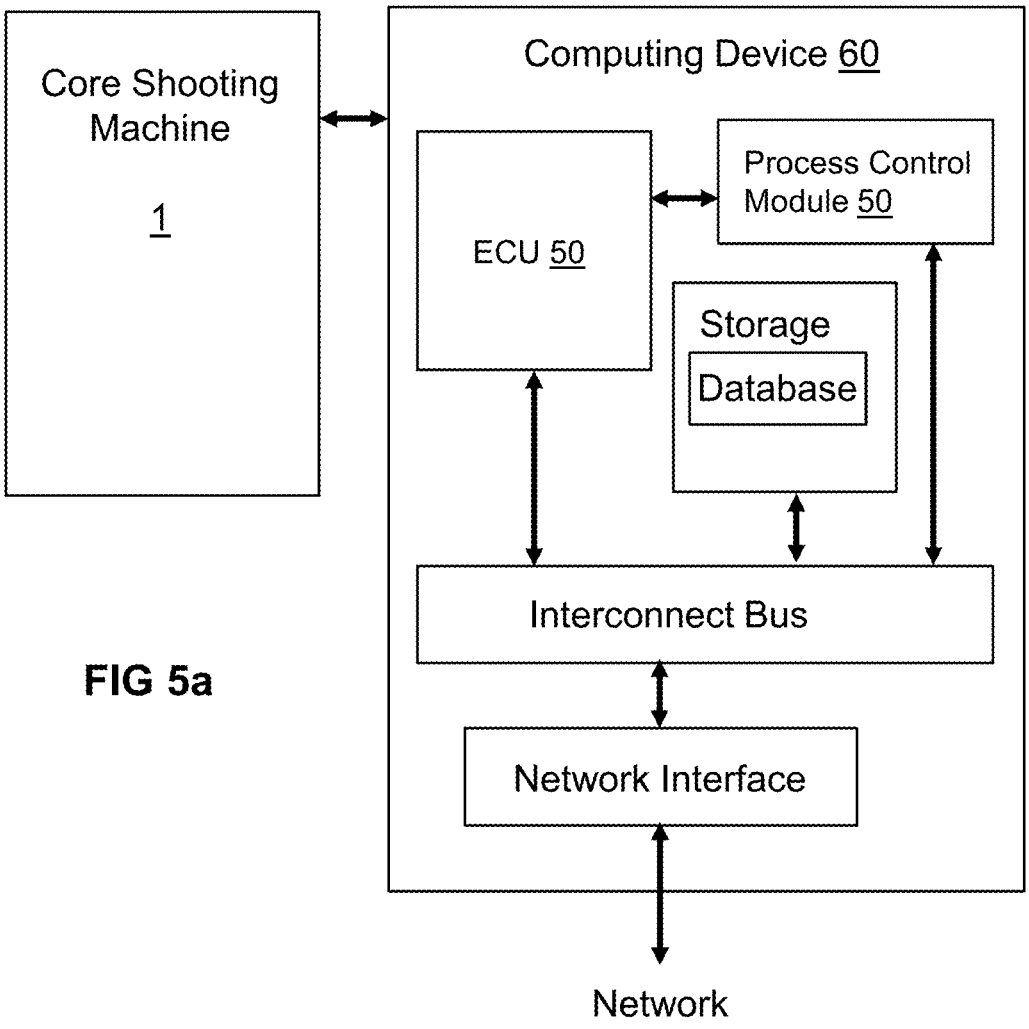
FIG. 5*a* is a diagrammatic representation of a control module coupled to the control unit of a core shooting machine.
Figure 5B:
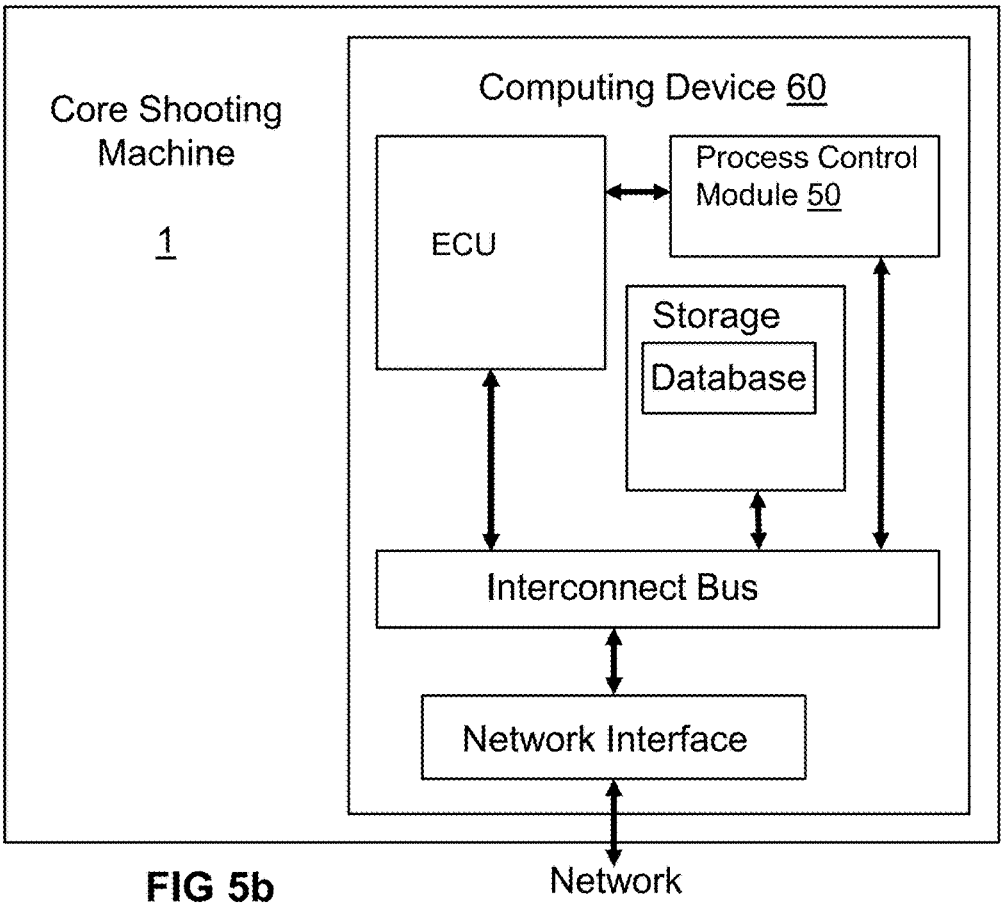
FIG. 5*b* is a diagrammatic representation of a control module integrated into the control unit of a core shooting machine.

An embodiment is linking the process control module 50 to or integrating it within the computing devices of core shooting machines 1. FIG. 5 represents an example embodiment.

Prior art core shooting machines 1 include a computing device or the machine control unit that can be linked to conventional computational devices. Diverse services may be executed by the computational devices. Process control is a typical task to be executed by a computing device.

For operating the main process core shooting, as described above, in particular the initial machine pressure $P_0$ in the pressure tank 10 is being controlled. Once adjusted to produce certain cores by using a certain core box, the value (e.g. 4 bar) is kept constant.

In the prior art there is no dynamic adjustment considering other variable process conditions. In particular, there is no rule based correlation between the initial machine pressure $P_0$, the filling degree of the shoot head 13, the operational status of the core box 18, other machine specific variable conditions and the resulting effects on the dynamic core shooting process.

The described embodiment provides relevant information for the dynamic operation of the core shooting process. In particular, the conditions of all relevant parts of the system are correlated to the transient mass flow of air and sand. The process control module 50 thus enables the assessment of the process and the dynamic optimization through real time adjustment of process conditions.

Example

If e.g. the filling degree of the shoot head 13, i.e. the sand height 21 in the shot cylinder 15 varies between two production cycles, the new situation can be calculated using the process control module the preferably the input of the new sand height value is measured within the core shooting machine 1.

Preferably, the data is available in the computing device 60 of the core shooting machine 1 and can be used directly and preferably automatically as input for the calculation. The output of the calculation is the transient pressure within the complete system, including the core box 18, as described above. Also, the transient flow of air and sand during the process is available, thus indicating the filling conditions for producing the core cavities 19 of the linked core box 18.

Using the process control module 50, the filling conditions can be compared to the cycle before or e.g. to reference conditions which may define an optimum (at least a preference) for the current machine in combination with the used core box. Variable process conditions can be iteratively varied in order to get e.g. the reference process conditions. As the calculation is conducted in very short time an iterative adjustment is executed before the next production cycle. For the next production cycle the machine pressure and other adjustable parameters can be set resulting in process conditions which are the nominal values (target values) for best as possible core production.

Computing devices typically include storage media, where data and databases can be generated or provided. The optimum process conditions for all situations that occurred for the combination of machine and the linked core box can additionally be stored in a database. The optimum process conditions are available without further calculation if the same situation occurs again. This extended approach for applying the present disclosure can be considered to be a self-learning system.

Other examples for variable process conditions are modifications of the core box where shoot nozzles 17 or vents 20*a* may be changed. A typical effect that changes the process conditions with time is the clogging of the vents 20*a*. Sand particles and cured binder are reducing the open area of the vents. The transient mass flow and the transient pressure are affected. Using the process control module the process conditions such as the initial pressure $P_0$ can be dynamically readjusted.

The simulation of the core shooting process, is extremely useful for the dynamic control of the process as described above. Additionally, the present simulation process can be used to design and to optimize core shooting machines 1. Geometry and size of the shoot head 13 are variables. Also, type and size of the valves 11 can be optimized in combination with and correlated to other relevant machine parts.

The aspects and possible implementations can be integrated into the computing device 60 of the machine 1 or linked to a computing device 60 that is in data connection with the machine 1 e.g. via a network and a network interface for the dynamic adjustment of the process. For designing and optimizing core shooting machines the concept can be used independent of the core shooting machine 1 by any computing device.

Figure 6:
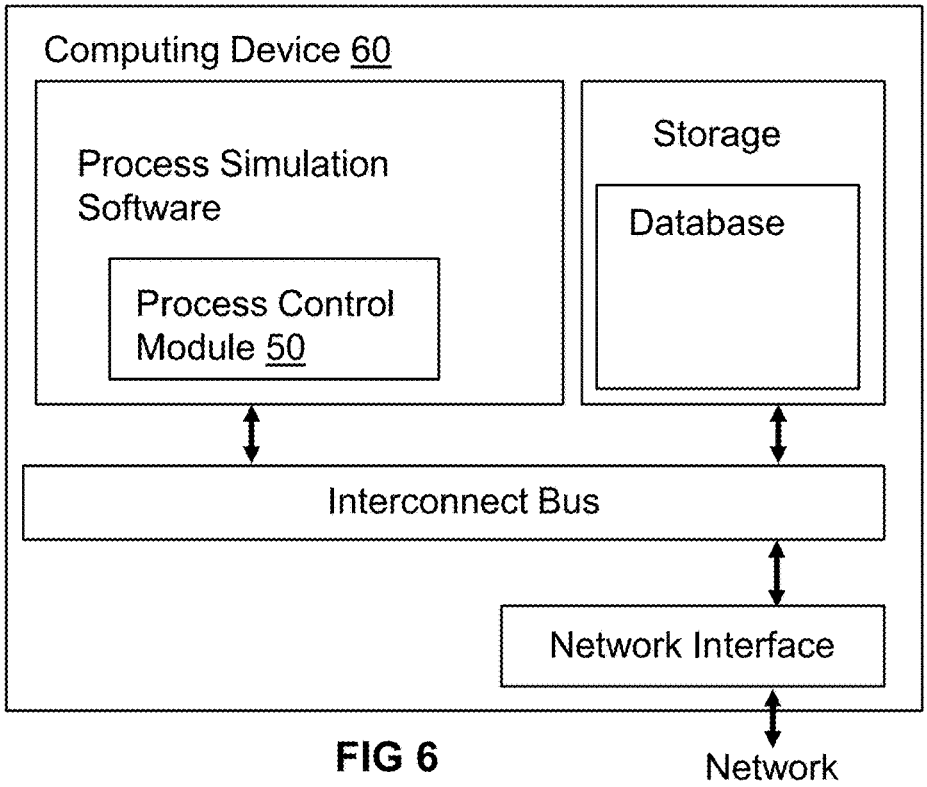
FIG. 6 is a diagrammatic representation of a process control module integrated in or coupled to 3D simulation software.

The core shooting process can also be simulated with simulation software for 3D process simulation. FIG. 6 sketches an exemplary set-up on a workstation 60 (computing device 60).

3D process simulation today is state of the art. Process simulation of two phase flow of air and sand is highly complex. The mathematical-physical models that are available and used typically simplify the complex reality. Typically, there is a lack of measured data for the adjustment of variable process conditions. For conducting simulation in practice typically approved and reasonable data is used.

Representing the complete system in the simulation as shown in FIG. 1 typically results in high calculation effort. If machine specific details are to be analyzed in detail it is necessary to represent the complete system best as possible.

Usually, it is a goal for process simulation to optimize the design of core boxes 18 and to optimize the quality of the cores. Preferably the simulation domain includes the relevant parts of the core box 18 and preferably the shoot nozzles 17.

The machine specific conditions are set as boundary conditions. At the shoot nozzles 17, pressure as well as air and sand boundary conditions are set. The appropriate definition of a transient pressure condition is typically set by experience of the user. The initial pressure $P_0$ of the pressure tank 10 does not represent directly the condition at the shoot nozzles 17.

The described embodiment provides the missing transient pressure, the transient mass flow and the transient velocities separately for both, air and sand, to be used dynamically in accordance with the progress of the shooting process.

The user of the simulation software can load a machine dataset which includes all relevant specific data. The data may also be directly typed in by using an appropriate interface. The only further input that is required, are the actual process conditions as used at the real core shooting machine 1. The user can apply e.g. the initial machine pressure $P_0$ and the sand height in the shoot head 13.

In advance of the process simulation the calculation using the process control module provides the transient pressure and the described transient data for air and sand.

The transient data is used as dynamic boundary condition for the 3D simulation. Air pressure, mass flow and velocities for air and sand are dynamically changed with the progress of the process. By applying the present teaching to process simulation the accuracy of results is significantly increased. The simulation user receives accurate boundary conditions which are independent of personal experience.

3D process simulation is an appropriate tool for the design of core boxes 18. Simulation may also be used for designing shoot head geometries which may additionally consider the core box 18 to be applied. Accordingly, the accuracy will be increased significantly. The results of the simulation can be transmitted from the computing device 60 to a recipient via a network.

Another application is to interlink the core shooting machine 1 respectively the core shooting process and the 3D process simulation. The simulation can be adjusted by real process data and the real process can be improved by usage of advanced simulation results. The process control module in both cases uses the same data and data easily can be exchanged between both systems.

The core shooting machine 1 is connected to a network as well as workstations 60 are on which process simulation is executed. The core shooting machine 1 and the simulation software can directly exchange data where the process control module is the link, providing the common language and the process determining information as described.

The method is in an embodiment process used to calibrate the process conditions upfront to the next cycle through comparison of the actual production conditions to the nominal state and subsequent re-adjustment in case of deviation in order to ensure nominal condition.

In an embodiment, the method is used to control the settings of the core shooting machine in order to enable pre-defined process conditions, i.e. the method is used to optimize the "physical" set-up of production units (optimum process conditions).

The core shooting machine 1 and/or the computing device 60 can be provided with a user interface for receiving user input, such as e.g. data required for the model and for displaying output. The user input may comprise (as nonexhaustive list) relevant production process conditions and data defining molded part/cavity. The user interface may comprise a display on which simulation results are displayed. The simulation results are in embodiment stored in a database. The database may be part of the computing device 60 or the workstation 60, or maybe a separate computer readable medium. The software for performing the simulation is in an embodiment stored on a computable readable medium.

The various aspects and implementations has been described in conjunction with various embodiments herein. However, other variations to the disclosed embodiments can be understood and effected by those skilled in the art in practicing the claimed subject-matter, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems.

The reference signs used in the claims shall not be construed as limiting the scope.

The invention claimed is:

1. A method for controlling a core shooting machine for producing cores by a process of shooting a core sand mixture into at least one cavity in a core box that is associated with the core shooting machine, the core shooting machine comprising:

a source of compressed air at an adjustable initial machine pressure, the adjustable initial machine pressure being an adjustable process condition of the process, and a shooting head fluidically coupled to the source of compressed air by at least one conduit that includes an electronically controlled shot valve, the shooting head being configured for containing an amount of the core sand mixture, resulting in a filling degree of the shooting head, the filling degree being an adjustable process condition of the process, the method comprising performing a simulation of the process on a computing device, using a model of the process, on the basis of several process conditions, including the adjustable process conditions, and determining an improved or optimal value for one or more adjustable process conditions based on the result of a performed simulation, and adjusting one or more of the adjustable process conditions in accordance with the determined improved or optimal value.

2. The method according to claim 1, comprising solving a system of coupled equations to determine transient fluid flow of the sand core mixture and air.

3. The method according to claim 1, wherein the model is a mathematical-physical model of the process.

4. The method according to claim 1, wherein the model is a simplified 1-D representation of the process, considering a main local flow direction.

5. The method according to claim 1, comprising providing a recommendation based on the result of a performed simulation for the initial machine pressure and/or for the filling degree.

6. A non-transitory computer readable medium comprising computer program code for implementing a method according to claim 1, the non-transitory computer readable medium comprising:

software code of a computer model of a process of shooting a core with a core shooting machine, software code for performing a numerical simulation of the process using the model, and software code for outputting a recommended or optimal value for an adjustable process condition of the process.

7. A method for simulating, on a computing device, a process performed by a core shooting machine for producing cores by shooting a core sand mixture into at least one cavity in a core box that is associated with the core shooting machine, the method comprising:

informing the computing device of several process conditions, including one or more adjustable process conditions of the process, performing a simulation of the process on the basis of the process conditions, using a model of the process, and determining an improved or optimal value for the one or more adjustable process conditions based on the result of the simulation, wherein the model is a simplified 1-D representation of the process, considering a main local flow direction.

8. The method according to claim 7, wherein the computing device is configured to perform the simulation for each process cycle or for each given number of process cycles of the process, in less time than a process cycle.

9. The method according to claim 7, wherein the core shooting machine comprises a source of compressed air at an adjustable initial machine pressure, and a shooting head fluidically coupled to the source of compressed air by at least one conduit that includes an electronically controlled shot valve, the shooting head being configured for containing an amount of the core sand mixture, resulting in a filling degree of the shooting head; and wherein the one or more adjustable process conditions comprise the adjustable initial machine pressure, and the filling degree.

10. The method according to claim 9, comprising informing the computing device of one or more of the following process conditions:

length of opening time for the electronically controlled shot valve, characteristics of the electronically controlled shot valve, opening degree profile of the electronically controlled shot valve, shape and dimension of the at least one conduit upstream of shot valve, shape and dimension of the at least one conduit downstream of shot valve, shape, dimension or volume of the shooting head, shape, dimension or volume of a shot cylinder inserted in the shooting head, shape, dimension and number of openings, characteristics of the source of pressurized air, shape, dimension and number of shoot nozzles, shape, dimension and number of cavities, number, characteristics and positioning of vents, properties of sand core mixture.

11. The method according to claim 7, comprising solving a system of coupled equations to determine transient fluid flow of the sand core mixture and air.

12. The method according to claim 7, wherein the model takes into account interdependencies between the core shooting machine and associated at least one cavity in accordance with transient process conditions.

13. A method according to claim 12, comprising, calculating the mass balance of sand between the shooting head, shoot nozzles and core box cavity; and calculating the mass balance of air including an initial air mass within different parts of the core shooting machine and the core box and a loss of air during the process.

14. The method according to any claim 7, wherein the model is further simplified by considering air to be incompressible.

15. The method according to claim 7, wherein the model is further simplified by considering air to be compressible and considering sand to be incompressible.

16. A method according to claim 7, wherein the computing device is in data connection with the core shooting machine or is part of the core shooting machine.

* * * * *